US009636698B2

(12) United States Patent
Breault et al.

(10) Patent No.: US 9,636,698 B2
(45) Date of Patent: May 2, 2017

(54) DUAL CARTRIDGE PNEUMATIC DISPENSER INTEGRATED WITH DISPOSABLE ANTI-DRIP VALVE FOR PRECISION DISPENSING

(75) Inventors: John P. Breault, New Britain, CT (US); Andrew Bardon, Fairfield, CT (US); Karl Gabrielson, Burlington, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 688 days.

(21) Appl. No.: 13/451,964

(22) Filed: Apr. 20, 2012

(65) Prior Publication Data

US 2012/0285999 A1 Nov. 15, 2012

Related U.S. Application Data

(63) Continuation of application No. PCT/US2011/048568, filed on Aug. 22, 2011.

(60) Provisional application No. 61/377,158, filed on Aug. 26, 2010.

(51) Int. Cl.
*B05C 5/02* (2006.01)

(52) U.S. Cl.
CPC ..... *B05C 5/0225* (2013.01)

(58) Field of Classification Search
CPC .. B05C 5/0225; B05C 5/0229; B05C 11/1034
USPC ..... 222/145.5, 145.6, 375, 380, 501, 571, 222/137, 504, 559, 509, 146.5, 63, 333, 222/453, 518
See application file for complete search history.

(56) References Cited

U.S. PATENT DOCUMENTS

| | | | | |
|---|---|---|---|---|
| 1,260,501 | A * | 3/1918 | Wise | 222/153.09 |
| 1,788,810 | A * | 1/1931 | Tittemore | 239/415 |
| 2,640,630 | A * | 6/1953 | Genco | 222/509 |
| 4,229,413 | A * | 10/1980 | Marteau d'Autry | 422/517 |
| 4,363,429 | A * | 12/1982 | Schindler | 222/504 |
| 5,375,743 | A * | 12/1994 | Soudan | 222/145.5 |
| 5,624,059 | A | 4/1997 | Lo | |
| 5,816,456 | A * | 10/1998 | Graffin | 222/559 |
| 6,253,972 | B1 * | 7/2001 | DeVito et al. | 222/504 |
| 6,375,096 | B1 * | 4/2002 | Rashidi | 239/413 |
| 2002/0038826 | A1 | 4/2002 | Hurray et al. | |
| 2008/0073448 | A1 | 3/2008 | Kendall | |

FOREIGN PATENT DOCUMENTS

| | | |
|---|---|---|
| EP | 0505894 | 9/1992 |

OTHER PUBLICATIONS

International Search Report issued in connection with International Patent Application No. PCT/US2011/48568 mailed Feb. 9, 2012.

* cited by examiner

*Primary Examiner* — Paul R Durand
*Assistant Examiner* — Charles P Cheyney
(74) *Attorney, Agent, or Firm* — Steven C. Bauman

(57) ABSTRACT

The present invention relates to an anti-drip valve for precision dispensing fluid from a cartridge. The anti-drip valve includes a y-shaped anti-drip valve body and a poppet extending therethrough. The body and poppet create a seal within the anti-drip valve and control the flow of fluid from the valve to a dispense tip.

18 Claims, 5 Drawing Sheets

DUAL CARTRIDGE PNEUMATIC DISPENSER INTEGRATED WITH DISPOSABLE ANTI-DRIP VALVE FOR PRECISION DISPENSING

FIELD OF THE INVENTION

The present invention relates to a valve for the deposition of fluids such as an adhesive onto a substrate. Specifically, the present invention is directed to an anti-drip valve using with a dual cartridge for the deposition of fluid on a substrate.

BRIEF DESCRIPTION OF RELATED TECHNOLOGY

In the past the deposition of adhesives, sealants, lubricants and the like has been plagued by many problems. In the absence of any type of a mechanical dispenser, the application of such materials is more often than not a messy and inaccurate operation. Frequently, an expensive substance is haphazardly applied, wasting valuable material and generating unnecessary clean-up costs. Even the use of one of the many types of dispensers as known to those skilled in the art has failed to eliminate all of the problems. While many of these dispensing devices may dispense certain materials accurately, they are still not capable of producing uniform shots of a flowable material, the viscosity of which is subject to change, a common phenomenon in flowable materials such as epoxy resin adhesives. Nor can they accommodate a variety of materials having a wide range of viscosities. Conventional dispensers may reduce the wastage of material, but the necessary periodic readjustments of these dispensing devices produces undesirable "down-time", crating inefficiencies in a common production process situation. Maintenance and changeover of materials is also commonly time consuming and costly. Furthermore, many of the dispenser heretofore available are susceptible to undesirable dripping of material from the dispensing nozzle after dispensing the desired amount of material.

It would therefore be beneficial to obtain an improved flowable material dispenser that operates with continual accuracy despite changing viscosities of materials, accommodates a wide range of viscosities, operates at high flow rates, reduces maintenance and changeover costs, eliminates post-dispensing drippage, provides for instant on-flow/off-flow with a clean shut off, and provides a more efficient and dependable method for dispensing shots of flowable materials. Further, it would be beneficial to obtain an improved dispenser which is low cost, disposable, and provides for improved scaling areas.

SUMMARY OF THE INVENTION

In one aspect of the invention, there is provided an anti-drip valve for precision dispensing fluid from a cartridge; including a y-shaped anti-drip valve body and a poppet. The anti-drip body includes a vertical part and an angled part. The vertical part has a vertical channel therethrough and the angled part has an angled channel therethrough. The angled channel extends from the vertical channel. The vertical part includes a top section, middle section and bottom section. The top section extends from a top open end to the middle section, the middle section extends from the top section to the bottom section, and the bottom section extends from the middle section to the bottom opened end. The vertical part has varying diameters.

The poppet has a rod with a mushroom shaped end to prevent dripping of adhesive and control the flow of adhesive. The poppet extends through the vertical channel and beyond the top open end and the bottom open end. The poppet is vertically movable within the vertical channel to regulate the flow through the anti-drip valve.

In another aspect of the invention, there is provided an anti-drip valve for precision dispensing fluid from a cartridge including a y-shaped anti-drip valve body and a poppet. The y-shaped anti-drip valve body includes a vertical part and an angled part. The vertical part has a top open end, a bottom open end, and a vertical channel extending from the top open end to the bottom open end. The angled part has an angled open end and an angled channel extending from the angled open end to the vertical channel at an angle of about 60°. The vertical part has a top cylindrical section, middle funnel-shaped section and bottom cylindrical section. The top section extends from the top open end to the middle section. The middle section extends from the top section to the bottom section. The bottom section extends from the middle section to the bottom open end. The middle funnel-shaped section has a conical portion with a narrow thin tube portion extending therefrom. The narrow thin tube portion has a smaller diameter than the top section and the bottom section. The anti-drip valve body includes flanges extending from the top section and the bottom section. The poppet includes a solid rod with a mushroom shaped end. The poppet extends through the vertical channel and it is vertically movable within the vertical channel to control the flow of adhesive and prevent dripping of adhesive. The rod has an external surface in communication with the narrow thin tube portion.

In yet another aspect of the invention, there is included a method of assembly of a dual cartridge dispenser including the steps of providing an anti-drip valve including a y-shaped anti-drip valve body having a vertical part and an angled part, the vertical has a vertical channel therethrough and the angled part with an angled channel therethrough, the angled channel extending from the vertical channel, the vertical part including a top section, middle section and bottom section, the top section extending from a top open end to the middle section, the middle section extending from the top section to the bottom section, the bottom section extending from the middle section to the bottom opened end, the vertical part having varying diameters; and a poppet having a rod with a mushroom shaped end, the poppet extending through the vertical channel and beyond the top open end and the bottom open end, the poppet is vertically movable within the vertical channel; providing a dispensing tip including a dispensing hub with a thin tube extending therethrough; providing a dispenser including an actuator bracket, mounting bracket and shutoff assembly; attaching the dispensing hub onto the bottom section of the anti-drip valve defining an anti-drip valve assembly; installing the anti-drip valve assembly into the actuator bracket; securing the anti-drip valve assembly against the actuator bracket; lowering the actuator bracket to place the thin tube into a needle holder of the shutoff assembly; inserting a mix nozzle of an adhesive cartridge into the angled part; pushing the adhesive cartridge against the angled part to form a seal; and securing the adhesive cartridge to the mounting bracket.

DETAILED DESCRIPTION

FIGS. 1-6 show an anti-drip valve according to the present invention which provides the benefits as discussed above. The anti-drip valve is a disposable valve that may be used for the application of a variety of viscous fluids. The anti-drip valve may be used at the end of a static mix nozzle which attaches to a single or dual cartridge adhesive package. The anti-drip valve can also be used with bulk packaging and can be pumped to a manifold with a mix nozzle attached. The anti-drip valve is capable of dispensing small precise beads of adhesive, i.e. epoxy or MMA, or other fluid material onto a substrate without creating dripping. The anti-drip valve may be used in conjunction with a variety of pneumatic, mechanical or manual dispensers. The anti-drip valve system can be integrated onto all robotic systems or can be used as a stationary dispenser.

Figure 1:
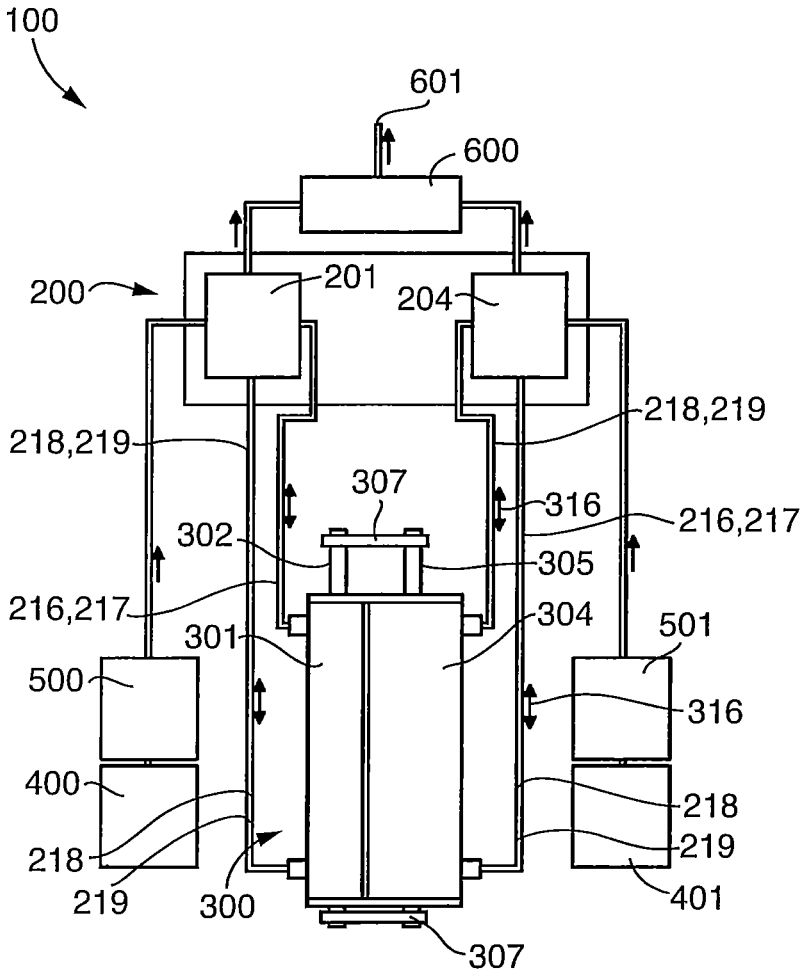
FIG. 1 is a perspective view of a dual cartridge dispenser with an anti-drip valve according to the present invention.

FIG. 1 shows a dual cartridge dispenser 10 including a cartridge pusher 12, a shutoff valve assembly 14 and a mounting bracket 16. The cartridge pusher 12 is attached to the mounting bracket 16 at one end of the dispenser 10 and the shut off valve assembly 14 is attached to the mounting bracket 16 at the other end of the dispenser 10. The shut off valve assembly is made up of an actuator, an anti-drip valve 22, a dispense tip 28, dispense tip locator and various brackets. The mounting bracket 16 positions the shut off valve assembly 14 and aligns the cartridge pusher with the anti-drip valve 22. The cartridge pusher 12 is positioned on an angle to provide for proper positioning and alignment of a dual cartridge adhesive package 18 placed therein. FIG. 1 shows a dual cartridge adhesive package 18 placed within the dispenser 10. The back end of the dual cartridge adhesive package 18 is positioned in alignment with the cartridge pusher 12 and the front end of the dual cartridge adhesive package 18 is attached to a mix nozzle 20. The mix nozzle 20 extends into the anti-drip valve 22. The anti-drip valve 22 is used in conjunction with the shut off valve assembly 14 and dispense tip 28 to provide accurate and dripless application of a fluid. The anti-drip valve 22 is attached to the dispense tip 28. The cartridge pusher 12 is designed to apply a force onto the cartridge adhesive package 18. In the case of a dual cartridge adhesive package the pushing action forces the adhesive into a static mixer. The two-part adhesive is mixed as it flows through the static mixer. The mounting bracket 16 aligns the static mixer/dual cartridge with the anti-drip valve 22. The force supplied by the cartridge pusher 12, which forces product from the cartridge 18, also applies a force on the mix nozzle which seals the interface between the mix nozzle 20 and the anti-drip valve 22 product inlet 32. The dispense tip 28 extends though the base of the shut off valve assembly 14. The product flows into the anti-drip valve 22. The anti-drip valve 22 is secured in the shut off valve assembly 14 and the poppet 58 is attached to an air actuator. The air actuator forces the poppet 58 on to the top of the dispensing tip cannular, or entrance path, 70. When the air cylinder is cycled the actuator pulls up on the poppet 58 allowing adhesive product to flow through the dispensing needle or tip 28.

Figure 2:
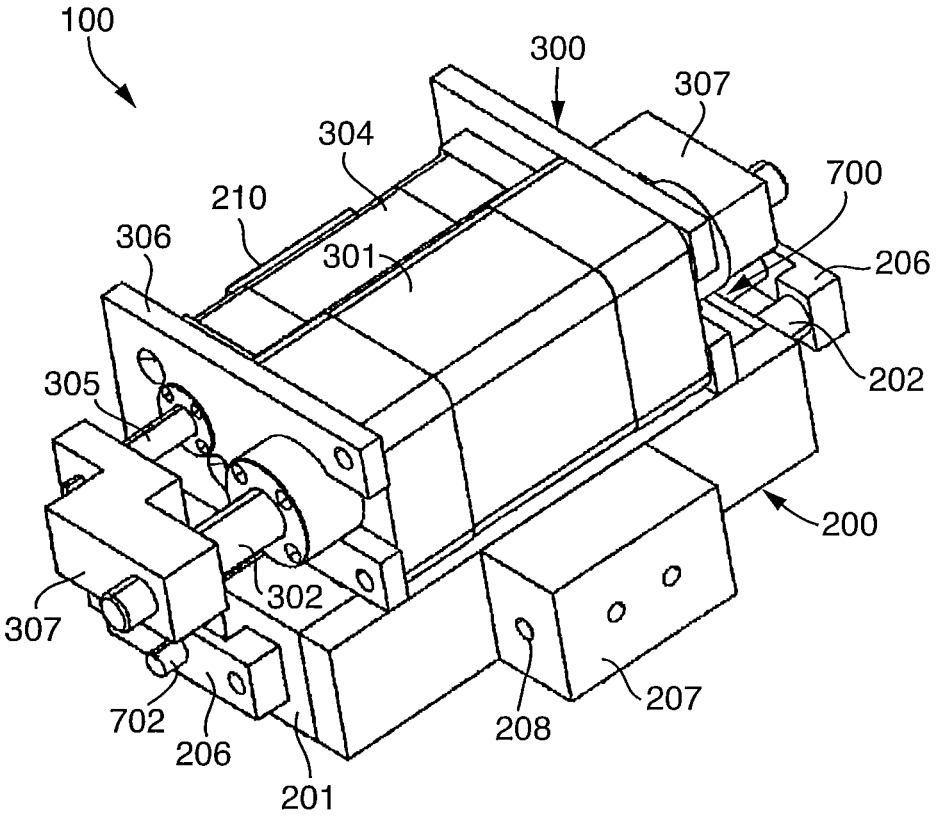
FIG. 2 is a perspective view of an anti-drip valve assembly according to the present invention.
Figure 3:
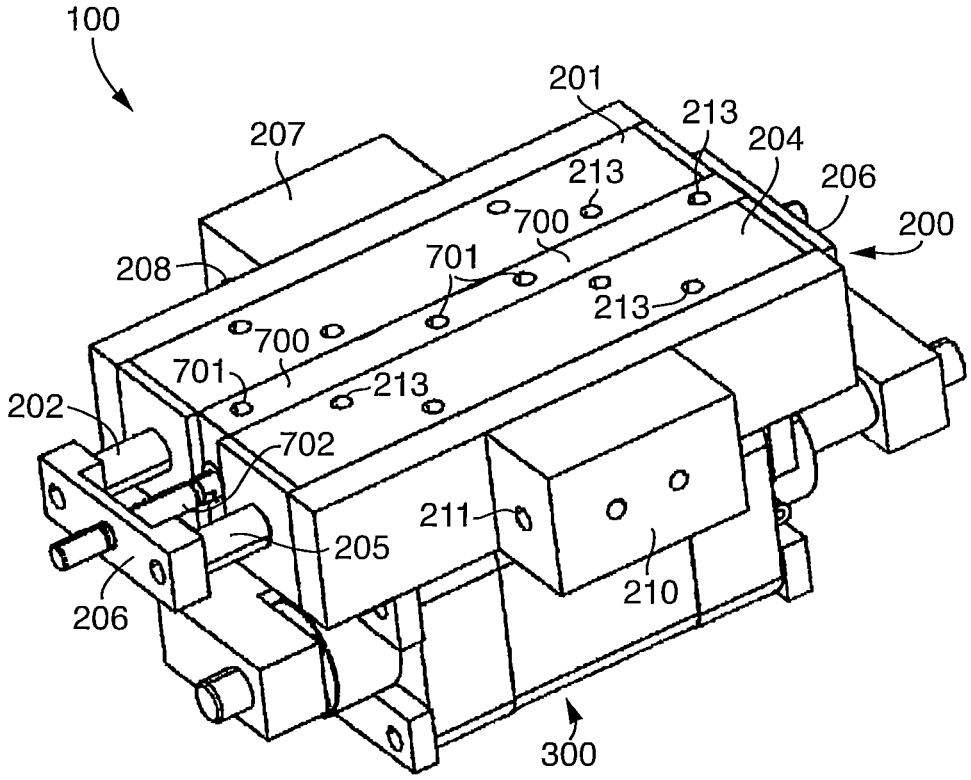
FIG. 3 is a perspective view of an anti-drip valve according to the present invention.

FIG. 2 shows an anti-drip valve assembly 26 of the present invention. The anti-drip valve assembly 26 includes an anti-drip valve 22 and a dispensing tip 28. FIGS. 2-6 show the anti-drip valve 22 including an anti-drip valve body 23 and a poppet 58. The anti-drip valve body 23 has a y-shape. The valve 22 has a vertical part 30 with varying external diameters or circumference and an angle part 32 extending from the vertical part 30. The vertical portion 30 controls the flow of fluid through the anti-drip valve 22 into the dispensing tip 28. The angled part 32 is the inlet for the fluid or adhesive to be dispensed. The vertical part 30 has two open ends 44, 46 and a central section extending therebetween. The central section includes a top section 34, a middle section 38 and a bottom section 40. The top section 34 extends from the top open end 46 to the middle section 34. The top section 34 is cylindrical in-shape having an internal diameter D and an external circumference C. Greater than half way along the outer surface of the top section 34, closer to the middle section 38, is a protruding flange 36 which serves as a stop to allow the shut off valve assembly 14 to seat therein. Attached by material continuity to the top section 34 is a middle section 38. The middle section 38 extends by material continuity from the top section 34 to the bottom section 40. The middle section 38 has a funnel shape with a conically shaped portion extending from the top section 34 which decreases in diameter and circumference to a narrow tube portion. The narrow tube portion has an external circumference smaller than the external circumference C. Extending from the end of the tube portion is the bottom section 40. The bottom section 40 extends from the middle section 38 to the open bottom end 44. The bottom section 40 is cylindrical in-shape and slightly tapers inwardly along the length towards the open bottom end 44. The varied external circumference of the bottom section 40 is smaller than the external circumference C but larger than the narrow tube portion of the middle section 38. The bottom section 40 includes a protruding flange 42 which extends from the outer surface of the bottom section 40 closer to the middle section 38. The protruding flange 42 is a stop for the edge of the dispensing tip 28 to abut and seat to prevent the dispersing tip 28 from riding up the anti-drip valve 22. FIG. 3 shows a lip 48 below the protruding flange 42. The external surface of the bottom section 40 from the lip 48 to the open bottom end 44 is a luer taper which slightly tapers to a reduced diameter. The external surface of the bottom section 40 above the lip 48 has a constant external circumference which is slightly smaller than the circumference at or right below the lip 48 thus forming the slight intent or lip 48 about the external surface of the bottom section 40. Additionally, the point of transition from the bottom section 40 to the middle section 38 is indented or a transition lip 50 to account for the change in external circumferences between the smaller circumference middle section 38 and the larger circumference bottom section 40.

Extending at an angle A of between about 90° to about 30°, preferably at an angle A of about 60°, from the vertical part 30 is the angled part 32. The angled part 32 is conical in-shape with a larger open end 52 which tapers down to a smaller end 54. The smaller end 54 merged into the protruding flange 42 of the bottom section 40, the portion of the bottom section 40 above the flange 42. A flat plate 56 extends between the angles part 32 and the middle section 38 of the vertical part 30 to provide support between the angled part 32 and the vertical part 30. The interiors of the vertical part 30 and the angled part 32 have connecting channels or passageways therethrough providing paths for the adhesive to flow and/or the valve control device 58 to extend therethrough. The angled part 32 is the inlet for the mix nozzle 20 of the adhesive package 18. The angled part 32 the mix nozzle 20 adjoin together, the mix nozzle 20 is placed within the angled part 32, to supply the fluid/adhesive from the angled part 32 into the bottom section 40. Extending through the channels of the vertical part 30 is the valve control device or poppet 58. The poppet 58 is a solid cylindrical rod 60 with a mushroom-shaped end 62. The rod 60 extends through the open top end 46 and out the bottom end 44. The poppet 58 is long enough to extend at least about 0.2 inches from the bottom end 44 and also extend out the top open end 46 to connect with the actuator bracket 24 or shut-off control driver. The mushroom-shaped end 62 is at the bottom of the rod 60 near the bottom end 40 of the vertical part 30 and controls the flow of fluid/adhesive exiting the valve into the dispensing tip 28. The external surface 61 of the solid rod 60 is in communication with and rubs against the internal surface 37 of the narrow thin tube 39 to create a seal in the middle section 38 preventing the adhesive or fluid from exiting the bottom section 40 and entering into the top section 34.

Figure 5:
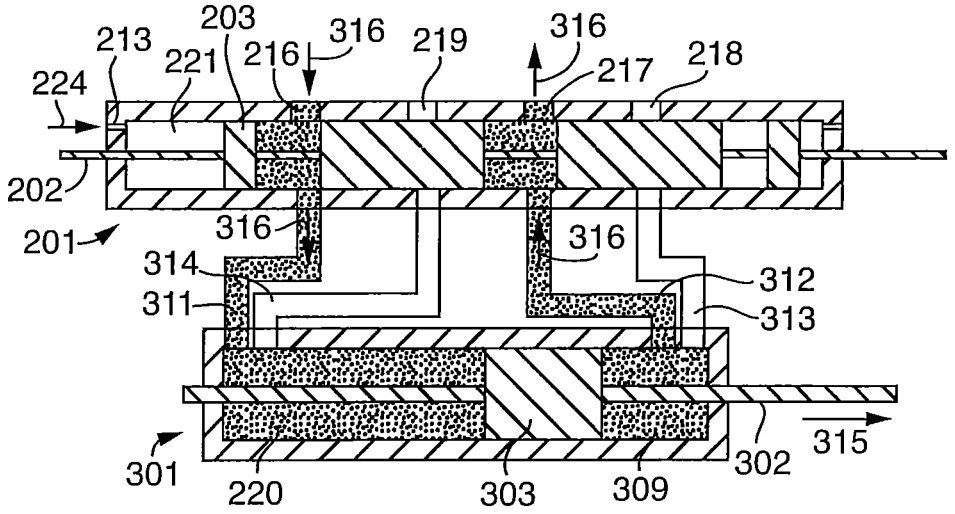
FIG. 5 is a sectional view of an anti-drip valve assembly in a closed position according to the present invention.
Figure 6:
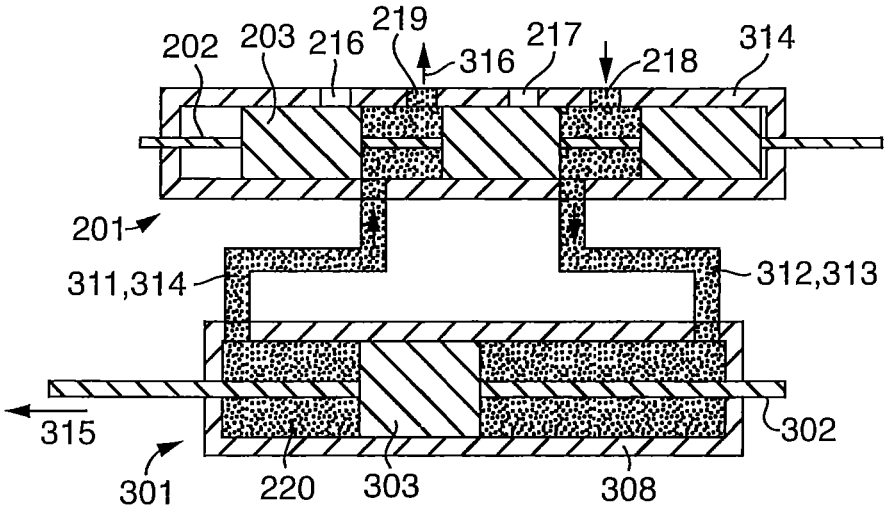
FIG. 6 is a sectional view of an anti-drip valve assembly in an opened position according to the present invention.

FIGS. 5 and 6 show the internal channels or passageways of the anti-drip valve 22. The rod 60 extends through the top passageway 63 of the top cylindrical section 34. The top passageway 63 is generally cylindrical in shape. Extending from the top passageway 63 is a middle passageway 64 which includes a narrower diameter cylindrical shaped portion. The middle passageway 64 is just slightly large in diameter than the rod 60 of the poppet 58. The outer surface of the rod 60 is in contact with the inner surface of the middle passageway 64 to allow for the rod 60 to move vertically within the passageway but also to prevent the adhesive/fluid from escapes through the middle passageway 64 between the rod 60 and the surface of the middle passageway 64. The transition passageways 65, 66 are shown as a cone which is a pyramid with a circular cross section to provide for the transition from larger to smaller diameter passageways and vice versa. The bottom section 40 includes a bottom cylindrical passageway 67 which extends from the transition passageway 66 to the open bottom end 44. The poppet 58 extends from the top open end 46, through the passageways 63, 64, 65, 66, and 67 and out the bottom open end 44. The poppet 58 is slides vertically up and down through these passageways to control the flow of the fluid through the anti-drip valve 22 and to the dispensing tip 28. The mushroom end 62 of the poppet 58 has a diameter larger than the middle passageway 64 which prevents the poppet 58 from being pulled vertically out from the top open end 46.

Connecting to the interior sidewall 68 of the middle passageway 64 is an angled passageway 69 which is the internal channel of the angled part 32. The angled passageway 69 is an elongated cone shape which connects and opens into the bottom passage 67. The fluid such as adhesive flows through the angled passageway 69, into and through the bottom passageway 67 and out the open bottom end 44.

Figure 4:
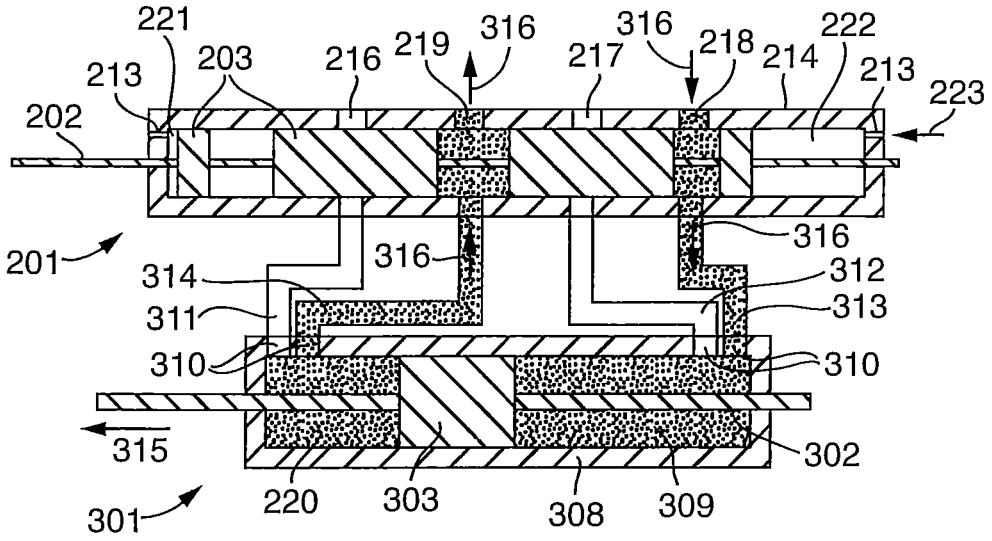
FIG. 4 is a perspective view of an anti-drip valve assembly according to the present invention.

FIG. 4 shows a dispensing tip 28 attached to the bottom section 40 of the anti-drip valve 22. The dispensing tip 28 includes a hub 28A and a thin tube 28B extending therethrough. The hub 28A seats on the bottom section 40 or luer taper of the anti-drip valve 22. The outer edge of the hub 28A is about 0.04 inches or less from the protruding flange 42 when attached to the anti-drip valve 28.

The method of assembly of the dual cartridge dispenser includes the following steps: install the dispensing tip 28 onto the bottom section 40 of the anti-drip valve 22; install the anti-drip valve 22 into the actuator bracket 24 and insure that the flange 36 is up against the bracket 24 and tighten the set screw to secure it in place; drop or lower the actuator bracket 24 so that the dispense tip 28 is positioned in the needle holder 25; insert the mix nozzle 20 into valve 22 and lock ram cylinder; energize product ram cylinder to about 40 psi, this forces the valve 22 into needle hub 28B; push down on the actuator bracket 24 until the bracket 24 touches valve flange 36; and lock the actuator bracket 24. The valve 22 is ready for dispensing fluid.

FIGS. 5 and 6 show the method of operation of the anti-drip valve 22. FIG. 5 shows the anti-drip valve 22 in the closed position. The mushroom end 62 of the poppet 58 plugs the entrance path 70 of the dispensing tip 28 such that the fluid in the anti-drip valve 22 is prevented from entering the thin tube 28B of the hub 28. FIG. 6 shows the anti-drip valve 22 in the opened position. The poppet 58 has been moved vertically upwardly extending out the open top end 46. The mushroom end 62 of the poppet 58 is lifted and spaced apart from the entrance path 70 of the dispensing tip 28. The space between the mushroom end 62 and the entrance path 70 allows the fluid to flow through the entrance path 70 into the thin tube 28B of the dispensing tip 28 and exit the tip 28 onto the substrate below. The poppet 58 may be moved vertically to various positions by varying the distance between the mushroom end 62 and the entrance path 70 to control the flow and amount of fluid/adhesive dispensed onto the substrate.

The shut-off assembly 14 controls the vertical motion of the poppet 58. The shut-off assembly 14 may be a manually controlled, pneumatically controlled, mechanically controlled, and the like to move the poppet 58 vertically up and down to control the position of the mushroom end 62 and the flow of the fluid through the anti-drip valve 22. The angles part 32 is a product inlet port of the anti-drip valve 22. The container or tube containing the fluid/adhesive to be dispensed seats within the angled passageway 69. The fluid flows through the angled passageway 69 and into the bottom passageway 67. The fluid flows by use of gravity or mechanical means to force the fluid into the passageways. The fluid only flows through the tube 28B of the dispensing tube 28 when the poppet 58 is in the opened position. The fluid is prevented from flowing through the dispensing tube 28 when the poppet 58 blocks the entrance path 70 by covering the tube 28B, as shown in FIG. 5. The anti-drip valve 22 is in the closed position.

Additionally, it is contemplated that the interior surface of the angled passageway 69 and/or top passageway 63 may be threaded or include other securement, locking or mating mechanisms to removably secure a tube, container, or fluid storage unit, as well as a mechanical or operation device controlling the poppet 58 to the thereto.

Further, the valve 22 is a single molded piece of rigid polymer which is disposable. Materials of construction include resins which provide dimensional stability, natural lubricity, high mechanical strength and excellent chemical resistance, such as acetal resin.

Figure 7:
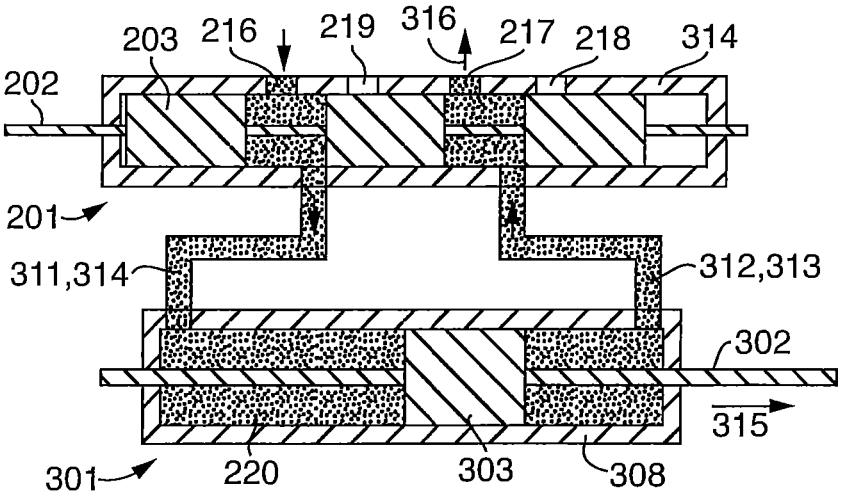
FIG. 7 is a flow rate comparison chart using the anti-drip valve assembly according to the present invention.

FIG. 7 shows a chart of the flow rate (g/sec) of an adhesive through the anti-drip valve of the present invention at various pressures (psi). The dispensing needle tip is 22 GA×0.6 mm. long. The adhesive used for the comparison is a medium adhesive, two part adhesive with a combined viscosity of approximately 30,000 cP. The chart shows the advantages of the anti-drip valve of the present invention over prior art valves. Specifically, the anti-drip valve of the present invention is capable of providing higher velocities of adhesive, or increased flow rates over the prior art at various pressures.

What is claimed is:

1. An anti-drip valve for precision dispensing fluid from a cartridge; comprising:

a y-shaped anti-drip valve body including a vertical part and an angled part, said vertical part has a vertical channel therethrough and said angled part with an angled channel therethrough, said angled channel extending from said vertical channel, said vertical part including a top section, middle section and bottom section, said top section extending from a top open end to said middle section, said middle section extending from said top section to said bottom section, said bottom section extending from said middle section to said bottom opened end, said vertical part having varying diameters;

a poppet having a rod with a mushroom shaped end for preventing dripping, said poppet extending through said vertical channel and beyond said top open end and said bottom open end, said poppet is vertically movable within said vertical channel to provide for controlled flow of fluid therethrough; and a dispensing tip attached to said external surface of said bottom section, said dispensing tip having an entrance path, and wherein said end of said poppet selectively plugs and lifts from said entrance path.

2. The anti-drip valve of claim 1, wherein said angled part attaches to said vertical part at about a 60° angle.

3. The anti-drip valve of claim 1, wherein top section has a cylindrical shape.

4. The anti-drip valve of claim 3, wherein said middle section has cylindrical shaped portion with a thin tube portion extending therefrom.

5. The anti-drip valve of claim 4, wherein said middle section has a smaller diameter than said top section.

6. The anti-drip valve of claim 5, wherein said bottom section has a cylindrical shape.

7. The anti-drip valve of claim 6, wherein said bottom section has a tapering diameter along the length of the bottom section.

8. The anti-drip valve of claim 4, wherein said thin tube portion has an internal surface and said rod has an external surface, said internal surface and said external surface are in communication with each other to form a seal therebetween.

9. The anti-drip valve of claim 1, wherein said anti-drip valve has an external surface with a flange extending about said external surface.

10. The anti-drip valve of claim 9, wherein said flange extends about said external surface of said top section.

11. The anti-drip valve of claim 10, further including another flange extends about said external surface of said bottom section.

12. The anti-drip valve of claim 9, wherein said external surface of said bottom section further includes a lip.

13. The anti-drip valve of claim 1, wherein said angled part is cylindrical in-shape.

14. The anti-drip valve of claim 1, further including a flat plate attached to said angled part and said middle section.

15. The anti-drip valve of claim 1, wherein said angled channel is cylindrical in-shape.

16. The anti-drip valve of claim 1, wherein said vertical channel includes a top cylindrical channel, a middle cylindrical section and a bottom cylindrical channel.

17. The anti-drip valve of claim 16, wherein said top cylindrical channel, a middle cylindrical section and a bottom cylindrical channel have different diameters.

18. An anti-drip valve for precision dispensing fluid from a cartridge; comprising:

a y-shaped anti-drip valve body including a vertical part and an angled part, said vertical part having a top open end, a bottom open end, and a vertical channel extending from said top open end to said bottom open end, said angled part having an angled open end and an angled channel extending from said angled open end to said vertical channel at an angle of about 60°, said vertical part having a top cylindrical section, middle funnel-shaped section and bottom cylindrical section, said top section extending from said top open end to said middle section, said middle section extending from said top section to said bottom section, said bottom section extending from said middle section to said bottom open end, said middle funnel-shaped section has a conical portion with a narrow thin tube portion extending therefrom, said narrow thin tube portion having a smaller diameter than said top section and said bottom section, said anti-drip valve body including flanges extending from said top section and said bottom section;

a poppet including a solid rod with a mushroom shaped end, said poppet extending through said vertical channel and said poppet is vertically movable within said vertical channel to control the flow of fluid therethrough, said rod having an external surface in communication with said narrow thin tube portion to provide a seal therein; and a dispensing tip attached to said external surface of said bottom section, said dispensing tip having an entrance path, and wherein said end of said poppet selectively plugs and lifts from said entrance path.

* * * * *